US006411184B1

(12) United States Patent
Comtois et al.

(10) Patent No.: US 6,411,184 B1
(45) Date of Patent: Jun. 25, 2002

(54) ELECTROMECHANICAL CONTACTOR

(75) Inventors: Patrick Comtois, Dijon; Patrick Larcher, Ahuy; Alain Moreux, Dijon; Régis Perrocheau, Couternon, all of (FR)

(73) Assignee: Schneider Electric Industries SA, Rueil-Malmaison (FR)

( * ) Notice: Subject to any disclaimer, the term of this patent is extended or adjusted under 35 U.S.C. 154(b) by 0 days.

(21) Appl. No.: 09/600,159

(22) PCT Filed: Dec. 1, 1999

(86) PCT No.: PCT/FR99/02980

§ 371 (c)(1),
(2), (4) Date: Aug. 1, 2000

(87) PCT Pub. No.: WO00/33341

PCT Pub. Date: Jun. 8, 2000

(30) Foreign Application Priority Data

Dec. 1, 1998 (FR) ..... 98 15184
Dec. 4, 1998 (FR) ..... 98 15384

(51) Int. Cl.[7] ..... H01H 67/02; H01H 63/00
(52) U.S. Cl. ..... 335/106; 335/126; 335/131; 335/132; 335/133
(58) Field of Search ..... 335/106, 126–135

(56) References Cited

U.S. PATENT DOCUMENTS 4,006,440 A * 2/1977 Lawrence et al.

FOREIGN PATENT DOCUMENTS

| | | | |
|---|---|---|---|
| DE | 4236890 A | * | 5/1994 |
| EP | 0036027 A | * | 9/1981 |
| EP | 0488203 A | * | 6/1992 |
| EP | 0595697 A | * | 5/1994 |

* cited by examiner

*Primary Examiner*—Ramon M. Barrera
(74) *Attorney, Agent, or Firm*—Oblon, Spivak, McClelland, Maier & Neustadt, P.C.

(57) ABSTRACT

An electromechanical contactor that houses an electromagnet and a mobile contact carrier within one body.

The electromagnet 20 is situated at the rear of the body 10 and a command wiring plane PB is situated at the front of the power wiring plane PA. The command terminals B and the control terminals C are arranged in a forward command/control terminal block 60. The coil terminals 26 are connected to the command terminals B by transverse conductors 27 housed in grooves made between an internal surface of the body and an external surface of an arch-shaped casing.

7 Claims, 4 Drawing Sheets

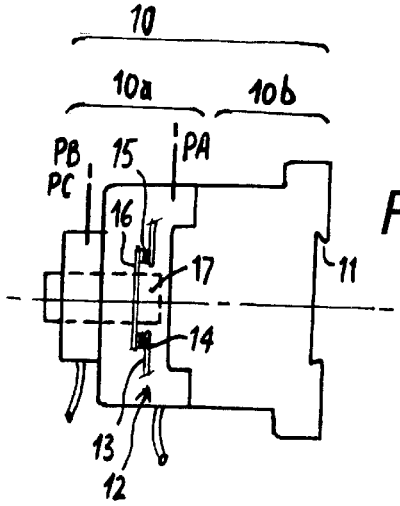
FIG. 1
FIG. 2
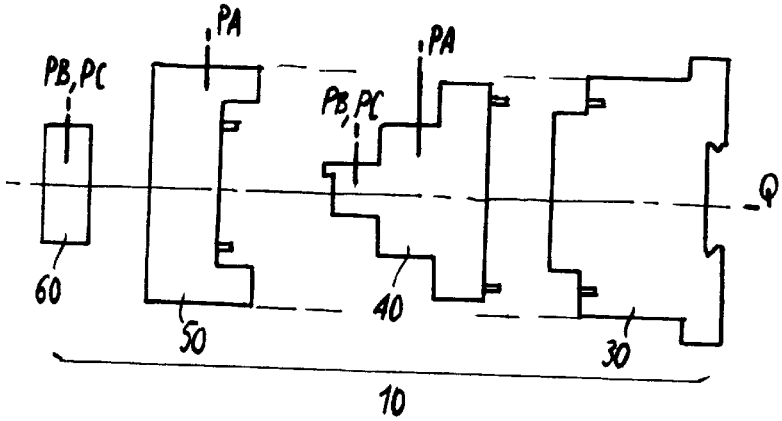
FIG. 3
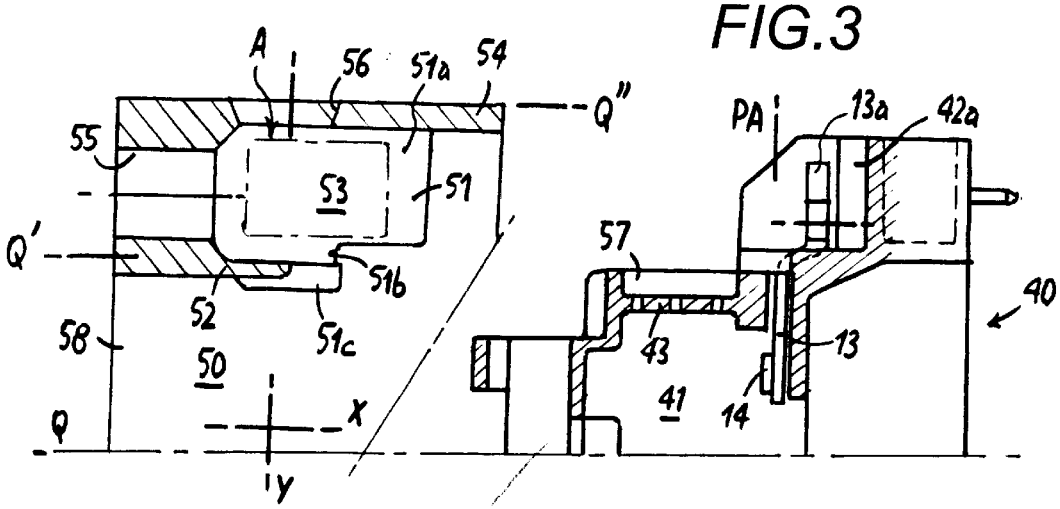

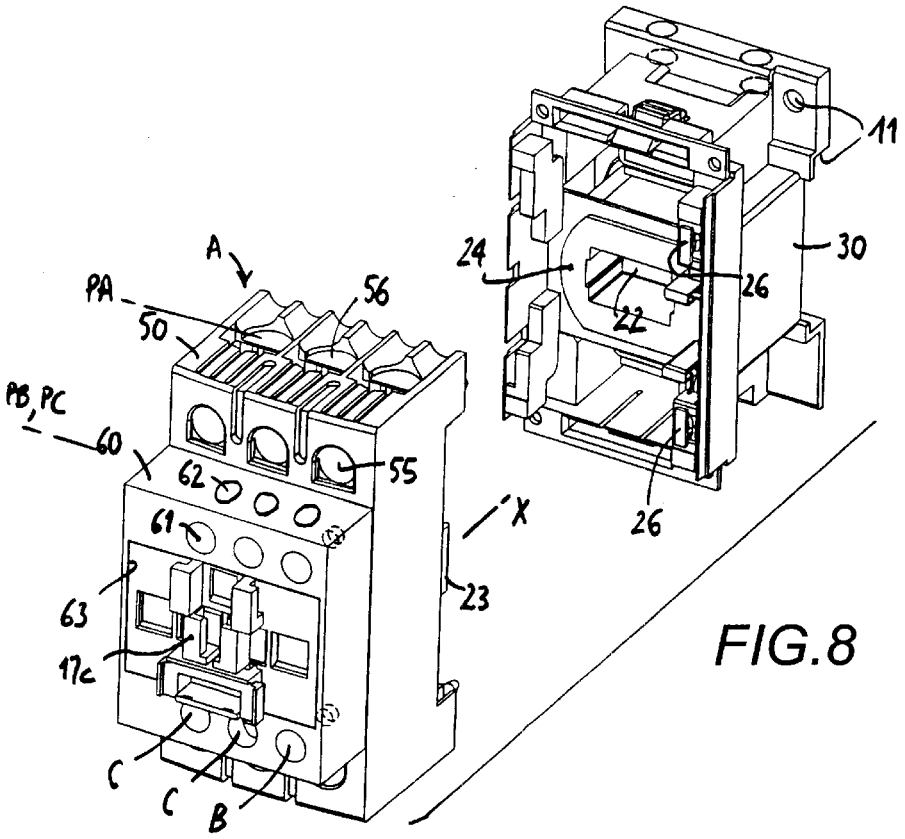
FIG.8
FIG.9
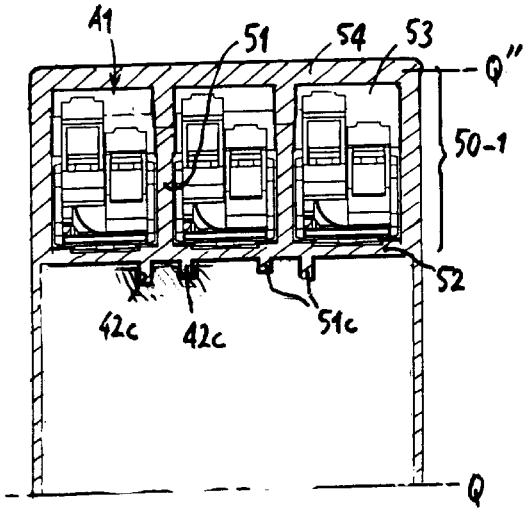
FIG.10
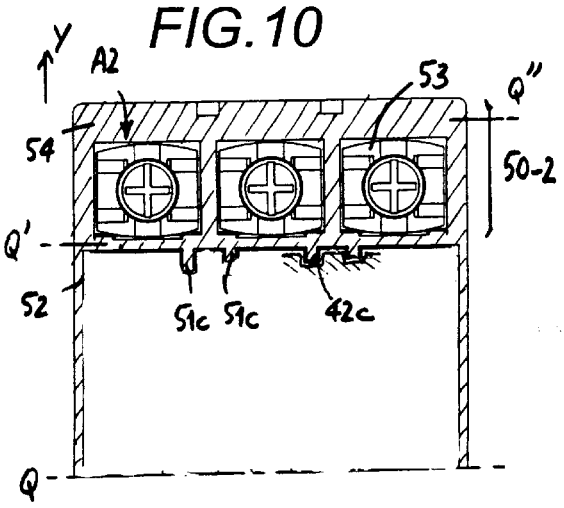

ELECTROMECHANICAL CONTACTOR

This invention relates to an electromechanical contactor comprising a body which is fitted with fixing elements and a support and houses an electromagnet and a mobile contact carrier, the electromagnet comprising a coil, a fixed armature and a mobile armature capable of moving the contact carrier, the body comprising power terminals and command terminals.

It should be recalled that the power terminals of the body are connected through conductive power components to fixed power contacts, that can be separated from mobile contacts on the contact carrier and are situated in a main wiring plane. The command terminals are connected to the coil terminals of the electromagnet and are situated in a command wiring plane.

It is known that, depending on the desired configuration, the electromagnet can be arranged at the front or at the rear of the body. It is useful to make clear that the word "front" refers to the side of the body through which one has access with a tool to the power terminals, the main wiring plane therefore being at the front of the body, and that the term "rear" refers to the side of the body fitted with fixing elements.

In certain contactors, currently used, where the coil of the electromagnet is housed at the rear of the body, the command wiring plane is also arranged, as a consequence and in a logical manner, at the rear of the arch-shaped casing which constitutes the essential part of the body and, at the same time, forms a fixing base for the contactor by screwing or clicking onto a support such as a profiled shape or a plate. An additional control device can be added on to the front of the body, the terminals of this additional unit defining a control wiring plane arranged at the front of the main wiring plane.

The command wiring is differentiated from the power wiring, but its layout cannot be modified without leading to a change in the arch-shaped casing. Furthermore, it is disadvantageous that the addition of power terminals of different types to these contactors can only occur if different bodies are provided.

In other contactors with a rear coil, currently used, the command wiring plane is mixed with the main wiring plane. The partitioning required on the one hand between the various power terminals and on the other hand between the command terminals and the neighboring power terminals is ensured by partitions provided on the arch-shaped casing.

The result is that the power wiring and the command wiring are not sufficiently differentiated and that if one wishes to fit a power connection with elastic terminals rather than one with screw terminals, it is necessary to provide different contactor bodies.

The aim of this invention is to facilitate, in a contactor with a rear coil layout, the differentiation between the power wiring on the one hand, and the command wiring and if the need arises the control wiring on the other hand.

Another aim is to simplify the production of a range of rear coil contactors capable of being fitted with power connection terminals of different types.

According to the invention, the electromagnet is arranged at the rear of the body and the command wiring plane is arranged at the front of the power wiring plane. Preferably, the command terminals are arranged in a command terminal block situated at the front of the contactor body.

Linking conductors that connect the terminals of the coil, housed in a rear part of the body to the command terminals, housed in a front part of the body extend perpendicular to the command and power wiring planes. Advantageously, the linking conductors extend in spaces such as grooves made between an internal surface of the body of the contactor and an external surface of an arch-shaped casing which contains the mobile contact carrier and which is arranged inside the body.

When control contacts are provided, the body of the contactor can house fixed control contacts and have control terminals connected to these fixed contacts, the control terminals being situated in a wiring plane mixed with the command wiring plane. The control terminals are preferably housed with the command terminals in a common command/control casing situated at the front of the contactor body and joined to it.

The body of the contactor can include a base at the rear which permits fixing to a support and the housing of the fixed components of the electromagnet and a power terminal block at the front which houses the power terminals, the base and the power terminal block forming an external envelope that caps an arch-shaped casing which protects the mobile contact carrier.

A description is made below of a preferred and non-limitative embodiment of the invention making reference to the appended drawings.

FIG. 1 is a diagrammatic side view of the contactor conforming to the invention.

FIG. 2 is a similar exploded view of the contactor.

FIG. 3 is a diagrammatic side view on a larger scale of the arch-shaped casing and the power terminal block.

FIG. 8 is a perspective view from the right of the base and the power and control-command terminal blocks.

FIGS. 9 and 10 show a front elevation of the two forms of fitting for the power terminal block.

Figure 4:
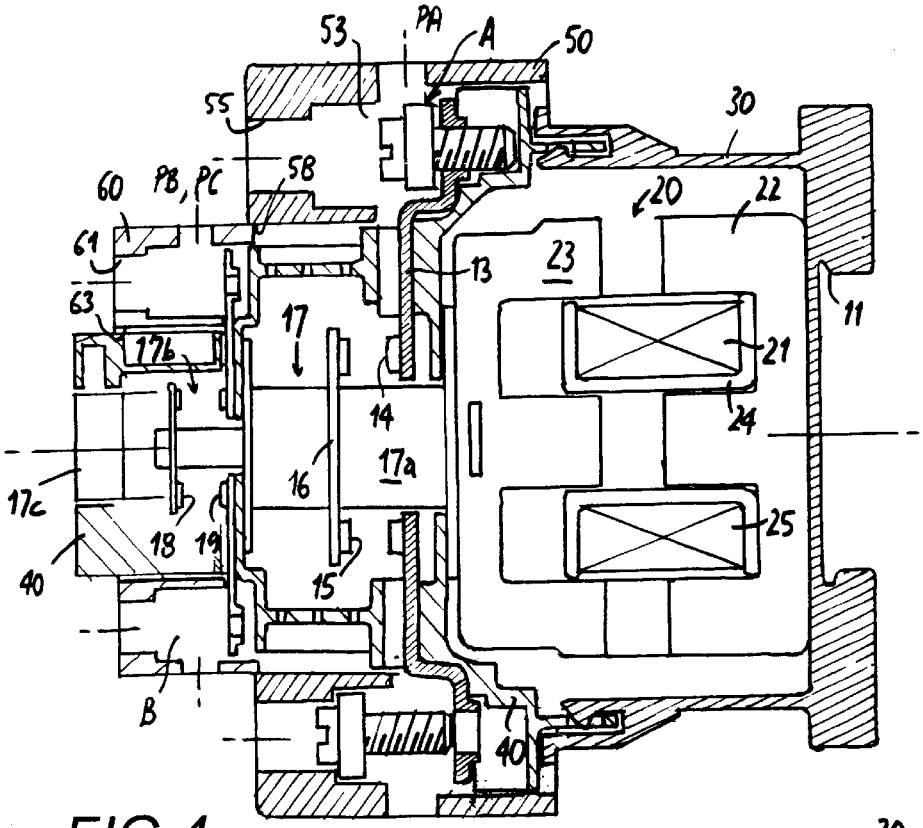
FIG. 4 is a side view in section of the contactor.

The multi-polar electromechanical contactor shown comprises a body, that is to say an external envelope 10 having a front part 10*a* and a rear part 10*b*. The front part 10*a* houses power terminals A, command terminals B and control terminals C. The rear part 10*b* is fitted with the usual elements 11 for fixing it to a support and houses an electromagnet 20. The body 10 includes power current lines 12 with double cut-off; these lines 12 have fixed conductive components 13 supporting fixed power contacts 14 as well as mobile power contacts 15 situated on contact bridges 16. The mobile contact bridges 16 are housed in a contact carrier 17 that can move as a function of actuation from the coil 21 of the electromagnet 20.

In the front part 10*a* of the body 10, the power terminals A are situated in a main wiring plane PA in order to provide for the insertion of wires leading to a power source and to a load in order to power up the current lines 13; furthermore, command terminals B are situated in the front part 10*a* which define a command wiring plane PB situated at the front of plane PA for the insertion of wires connected to a command circuit, these terminals being connected, inside the contactor, to the coil 21 of the electromagnet 20. Finally, in the front part 10*a* the control terminals C are situated which define a wiring plane PC situated at the front of plane PA and for example, mixed with plane PB, these terminals being connected through wires or a bus to a control, indication or analogue circuit.

In more detail, the body or casing 10 of the contactor includes a base 30 made of insulating material with the general form of a parallelepiped shaped dish; this base constituting the essential portion of the rear part 10*b* already mentioned and it is therefore fitted with fixing elements 11 and houses the coil 21 of the electromagnet 20 as well as the fixed armature 22 in the shape of an E with the core part of the E arranged vertically.

Figure 5:
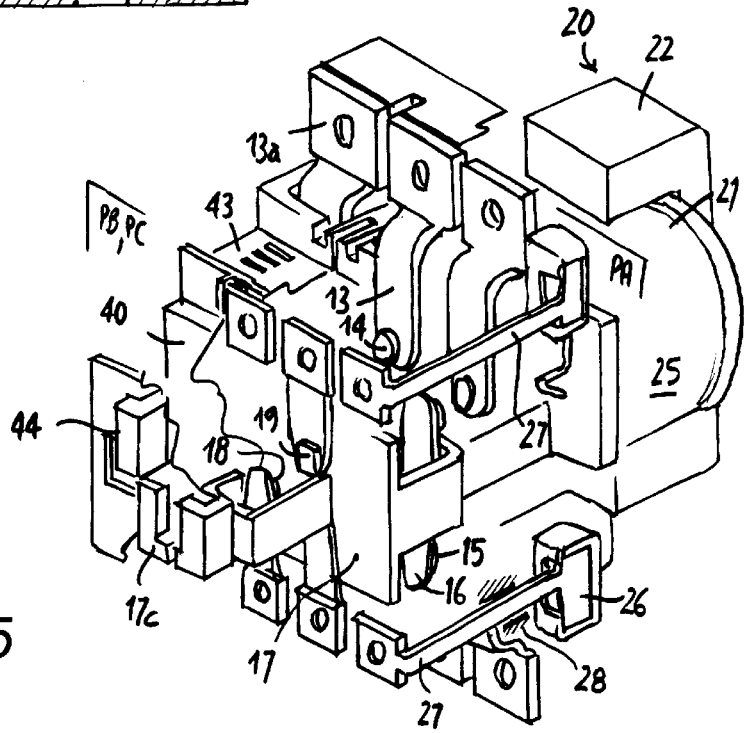
FIG. 5 is a perspective view from the right of internal elements of the contactor.

In the body 10 an arch-shaped casing 40 is situated made of suitable insulating material and housing a part of the moving armature 23 shaped like an E of the electromagnet 20 and the contact carrier 17. The contact carrier 17 (see FIGS. 4, 5 and 7) houses the contact bridges 16 that each carry the two mobile contacts 15 of the respective poles. Opposite the mobile contacts, respective fixed contacts 14 are situated which are connected through conductive components 13 to the power terminals A, the components 13 being, for this purpose fitted with threaded fixing flats 13*a*. The contact carrier 17 comprises a rear part 17*a* housing the power bridges 16 and a front part 17*b* housing the mobile control contacts 18 which co-operate with the fixed control contacts 19 as will be seen below. The contact carrier 17 has shapes acting as fittings 17*c* provided for the actuation of contacts belonging to an added device connected onto the front of the contactor.

The coil 21 has an insulating carcass 24 supporting the windings 25 and fitted with two coil terminals 26 intended to be connected to the command terminals B. The connection previously mentioned is made by means of respective conductive strips 27 directed substantially perpendicular to the front face of the contactor, these strips being housed in transverse grooves 28 provided in the outside of the arch-shaped casing 40.

The arch-shaped casing 40 has a staged shape, namely one stage defining the wiring plane PA with the purpose of making the power contacts—power terminals link and capped by a power terminal block 50, and one stage that defines the wiring plane PB,PC with the purpose of making the control/command contacts—control/command terminals link and capped by a control/command terminal block 60. The arch-shaped casing 40 is constituted by an assembly of two half-cases 40*a*, 40*b* along a horizontal plane which can be the median plane Q of the contactor or a plane parallel to Q. Each half-case 40*a*, 40*b* comprises internal partitions 41 intended to provide suitable insulation between the power contacts of the various poles, but which, on the other hand, does not have any external insulating partitions between the power terminals; each half-case comprises guides and grooves 42 that allow it to be put into place and allow the inter-terminal insulating partitions 51 provided to be positioned in the power terminal block 50. At the front of the arch-shaped casing 40, elements 44 are provided that allow an additional component to be hooked onto the front of the contactor.

Figure 6:
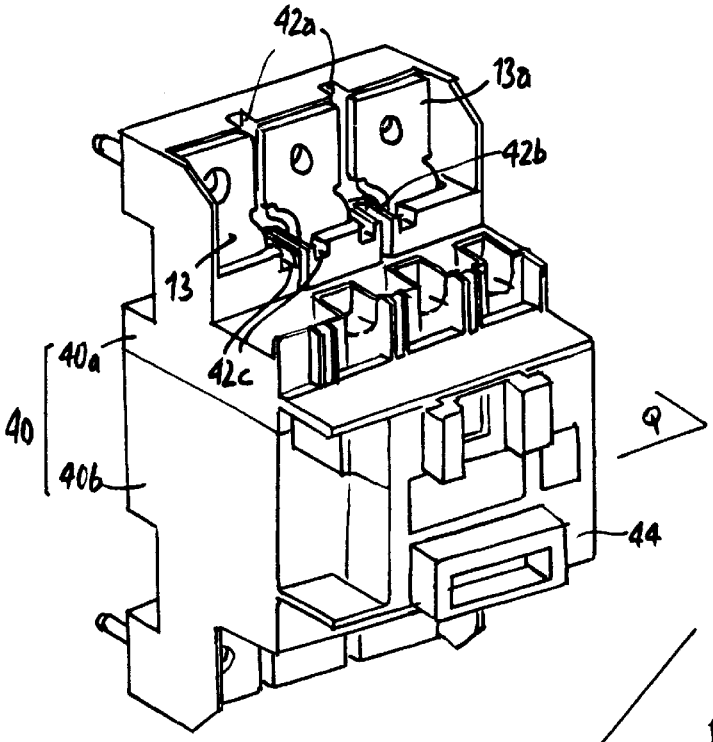
FIG. 6 is a perspective view from the left of the arch-shaped casing.
Figure 7:
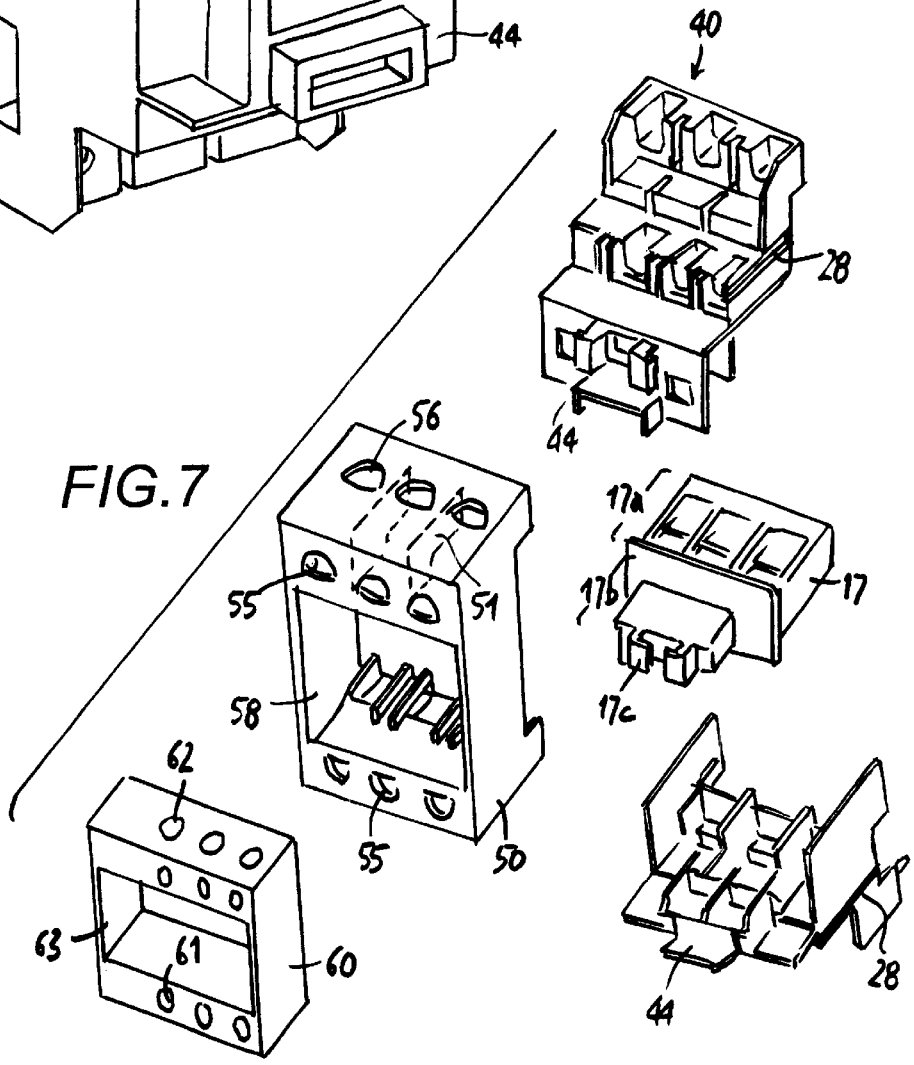
FIG. 7 is an exploded perspective view of the arch-shaped casing, the contact carrier, the power terminal block, the control-command terminal block, the fixed and the mobile contacts being absent.

As can be seen in FIG. 3 and also FIGS. 6 and 7, each partition 51 has a rear part 51*a* which goes into a corresponding groove 42*a* situated behind the adjacent fixing flats 13; the partition 51 also having a recessed part 51*b* which goes into a corresponding groove 42*b* situated at the active part (screw clip, elastic cage) of the power terminal A. The part of the partition situated towards the median plane Q of the contactor includes two slides 51*c* which co-operate with horizontal grooves 42*c* (see also FIGS. 9 and 10). It should be noted that the grooves 42*a*, 42*b*, 42*c* form, with the elements associated with the partitions 51, chicanes that increase the insulating distance between conducting power components. The power terminal block has a wall 52 in a plane Q' parallel to the median plane Q of the contactor which is used as a base plane for the terminal.

It should be observed that the power terminal block 50 can be adapted to two different types of connection without the arch-shaped casing having to be modified. By way of example FIGS. 9 and 10 show the addition to the arch-shaped casing of a terminal block 50-1 with elastic terminals A1 and respectively a terminal block 50-2 with screw terminals A2. As may be seen in FIGS. 3, 9 and 10, the space 53 devolved to the active or movable part of terminal A between the wall 52 and the adjacent external wall 54 of plane Q" of the terminal block has a volume variable in height (direction Y) and in depth (direction X) while the arch-shaped casing remains identical. The terminal block has front openings 55 that allow access to a tool for handling the terminals and top or bottom openings 56 situated in the wiring plane PA which are used for the insertion of power wires, the openings 55, 56 giving out into the space 53. A decompression volume 57 is formed between the wall 52 of the terminal block and a parallel wall 43, equipped with vent holes, for the arch-shaped casing. At the front, the terminal block 50 provides a window 58 traversed by the front part of the arch-shaped casing 40.

A command/control terminal block 60 is assembled at the front of the body of the contactor, this terminal block having front openings 61 that permit access by a tool for handling the terminals and top or bottom openings 62 situated in the wiring plane PB,PC and used to insert command and control wires. The terminal block 60 has a gauge which allows it to be flush mounted in the window 58 of the power terminal block 50 and it is fitted with a front opening 63 for passage of the front part of the arch-shaped casing 40.

It should be noted that the body of the contactor is constituted by the assembly of the power terminal block and the base so that these two elements form the external parison of the contactor and completely envelope the arch-shaped casing. The power terminal block 50 is fixed by all the usual means to the base 30 and the command/control terminal block 60 is fixed by all the usual means to the terminal block 50 and/or to the arch-shaped casing 40.

What is claimed is:

1. Electromechanical contactor comprising a body (10) equipped with elements for fixing to a support and housing an electromagnet (20) and a mobile contact carrier (17), the body comprising power terminals (A) connected through conductive power components to fixed power contacts that can be separated from mobile contacts supported by the contact carrier, and situated in a main wiring plane (PA) and command terminals (B) connected to the coil of the electromagnet (20) and situated in the command wiring plane (PB), characterized by the fact that the electromagnet (20) is arranged at the rear of the body (10)

the command wiring plane (PB) is arranged at the front of the power wiring plane (PA).

2. Contactor according to claim 1, characterized by the fact that the command terminals (B) are arranged in a command terminal block (60) situated at the front of the body (10) of the contactor.

3. Contactor according to claim 1, characterized by the fact that the linking conductors (27) that connect terminals (26) on the coil, housed in the rear part of the body (10) to command terminals (B), housed in a front part of the body, extend perpendicular to the command wiring (PB) and power wiring (PA) planes.

4. Contactor according to claim 3, characterized by the fact that the linking conductors (27) extend in spaces (28) such as grooves, made between a internal surface of the body (10) of the contactor and an external surface of an arch-shaped casing (40) which contains the mobile contact carrier (17) and which is arranged inside the body (10).

5. Contactor according to claim 1, characterized by the fact that the contact carrier (17) has mobile control contacts, the body (10) of the contactor housing fixed control contacts and having control terminals (C) connected to these fixed contacts and the control terminals (C) being situated in a wiring plane (PC) that is mixed with the command wiring plane (PB).

6. Contactor according to claim 5, characterized by the fact that the control terminals (C) are housed with the command terminals in a common command/control case (60) assembled at the front of the body (10) of the contactor.

7. Contactor according to claim 1, characterized by the fact that the body of the contactor comprises a base (30) for fixing the rear to a support and a power terminal block (50) housing power terminals (A), the base and the power terminal block forming an external envelope for an arch-shaped casing (40) which protects the mobile contact carrier (17).

* * * * *